US007014604B2

(12) United States Patent
Vergara

(10) Patent No.: US 7,014,604 B2
(45) Date of Patent: Mar. 21, 2006

(54) PAPER MACHINE ROLL COVER

(75) Inventor: Romeo G. Vergara, Salisbury, NC (US)

(73) Assignee: Voith Paper Patent GmbH, Heidenheim (DE)

( * ) Notice: Subject to any disclaimer, the term of this patent is extended or adjusted under 35 U.S.C. 154(b) by 24 days.

(21) Appl. No.: 10/198,855

(22) Filed: Jul. 19, 2002

(65) Prior Publication Data

US 2004/0014573 A1 Jan. 22, 2004

(51) Int. Cl.
*F16C 13/00* (2006.01)
*B21D 53/00* (2006.01)

(52) U.S. Cl. ..... 492/56; 492/59; 29/895.21; 29/895.32

(58) Field of Classification Search ..... 29/895.21, 29/895.32, 527.3, 458; 492/59, 48, 56
See application file for complete search history.

(56) References Cited

U.S. PATENT DOCUMENTS

| | | | | |
|---|---|---|---|---|
| 3,707,751 | A * | 1/1973 | Misch et al. | 492/53 |
| 3,920,325 | A * | 11/1975 | Switt | 399/313 |
| 4,768,761 | A * | 9/1988 | Kramer | 267/154 |
| 4,880,879 | A | 11/1989 | Bauman | 525/130 |
| 4,972,030 | A | 11/1990 | Bauman | 524/523 |
| 5,290,498 | A | 3/1994 | Shiraki et al. | 264/209.2 |
| 5,723,214 | A * | 3/1998 | Yamazaki et al. | 428/364 |
| 5,887,517 | A | 3/1999 | Liang et al. | 100/327 |
| 6,074,110 | A * | 6/2000 | Verlinden et al. | 396/612 |
| 6,187,867 | B1 | 2/2001 | Rau et al. | 525/221 |
| 6,328,681 | B1 | 12/2001 | Stephens | 492/56 |
| 2001/0012466 | A1 * | 8/2001 | Shida | 400/617 |
| 2002/0098961 | A1 * | 7/2002 | Chapman et al. | 492/56 |

FOREIGN PATENT DOCUMENTS

| | | |
|---|---|---|
| CA | 11147133 | 5/1983 |
| JP | 62-56118 | 3/1987 |
| JP | 4-63862 | 2/1992 |
| JP | 4-63866 | 2/1992 |
| JP | 4-272839 | 9/1992 |
| JP | 5-16298 | 1/1993 |
| JP | 5-43743 | 2/1993 |
| JP | 9-309958 | 12/1997 |
| JP | 10-250870 | 9/1998 |
| WO | WO97/47460 | 12/1997 |
| WO | WO00/43593 | 7/2000 |

OTHER PUBLICATIONS

Plasma Surface Modification of Polymers: Relevance to Adhesion description, http://www.polysurfacebookstore.com/pages/3659.html.*

* cited by examiner

*Primary Examiner*—Marc Jimenez
(74) *Attorney, Agent, or Firm*—Taylor & Aust, P.C.

(57) ABSTRACT

A paper machine roll cover surface layer has a mixture of an elastomeric material and HDPE particles. The HDPE particles have surface modification to improve roll cover performance.

30 Claims, 1 Drawing Sheet

PAPER MACHINE ROLL COVER

BACKGROUND OF THE INVENTION

1. Field of the Invention

The present invention pertains generally to industrial roll covers and, more particularly, to fillers provided in elastomeric roll covers used on paper machine rolls.

2. Description of the Related Art

Industrial rolls are used in many manufacturing processes, including steel mills, textile mills, and others. Paper machines in paper mills use a wide variety of different types of rolls in different environments for different purposes. Rolls on paper machine can be used for merely transporting the web from one location to another, or can be used in direct contact with the web or with paper machine clothing to treat the web, such as by pressing. The conditions under which paper machine rolls function can be quite harsh, including high temperatures and high pressures in the presence of corrosive chemicals. In addition, operating speeds are high, and ever increasing, and paper machine operation is substantially continuous.

It has been known to use steel roll shells or cores covered with different materials suitable for the particular location, operating conditions and roll performance requirements of the paper machine roll. Using a cover on the roll allows for quicker and less expensive reconditioning of the roll than replacing the entire roll. When a roll cover is damaged or worn, it can be reground easily, or stripped from the shell and replaced at lower cost than replacing the entire roll. By using different roll cover materials and formulations, the surface characteristics of the roll can be optimized for the location in the paper machine in which the roll is installed. Thus, desired and necessary hardness, abrasion and wear resistance, chemical resistance and other properties can be achieved. Both natural rubbers and synthetic elastomers have been used in paper machine roll covers. It also is known to use a plurality of different materials in layers between the roll shell and the top layer of the roll cover, as transition layers between the shell and the top layer, to promote roll cover life.

Efforts continue to make paper machines run faster, and to run for longer intervals between scheduled maintenance procedures. Chemicals used in the paper making process as conditioners, treatments and additives also are changing and improving. Thus, the demands on the performance of rolls and the covers on the rolls are also ever increasing. Synthetic fiber or particle fillers have been used mixed with the elastomer to improve paper machine roll performance, and to increase roll cover life.

It also is known to provide roll covers having a top layer made of a mixture of elastomeric material and ultra high molecular weight polyethylene (UHMWPE). According to one known composition range, the mixture includes about 100 parts elastomeric material by weight, and between about 25 and 50 parts UHMWPE by weight. Such roll covers may have a hardness between 10 to 50 P&J hardness scale.

While a roll cover comprising a mixture of an elastomer and UHMWPE as disclosed above has utility in paper machines for some paper making processes, and in some positions on the paper machine, it has certain shortcomings as well. A paper machine roll cover directly contacting the paper web must exhibit good sheet release properties. That is, the paper web, which may still contain a substantial amount of water and have minimal sheet strength, must release from the roll surface. If the web sticks or adheres to the roll surface, a web brake will occur, with the resultant waste of manufacturing time and product. Due to the large particle size of UHMWPE commonly used in rubber compounds, exposed particles on the cover surface limit the attainable surface smoothness, and thereby the sheet release properties of the roll cover. Adhesion between the elastomer matrix and the UHMWPE particles can be inconsistent, resulting in surface marking on the cover that translates to defects in the web being processed. Additionally, UHMWPE fibers and particles are expensive to obtain, thus substantially increasing the cost of the roll cover. Since paper machine roll covers commonly are re-ground with some frequency, and may require re-covering after a limited number of re-grindings, the additional cost from the use of UHMWPE fibers or particles can increase substantially the cost of operating a paper machine.

It also is known to provide roll covers comprising a polymeric material into which have been dispersed polyethylene particles that have been surface treated to alter the properties of the mixture. For example, U.S. Pat. No. 4,880,879, entitled "ABRASION RESISTANT COMPOSITE MATERIAL AND PROCESS FOR MAKING THE SAME", issued Nov. 14, 1989, discloses a material and a process for the material, having polyethylene particles in a thermoset polymeric matrix, the particles having been surface treated to enhance the bonding between the particles and the polymeric matrix. While the particles are called "high molecular weight polyethylene (HMW PE) particles", the molecular weight of the particles is said to be at least 1 million, and preferably in a range of 1 to 9 million. Thus, a roll cover made from such a mixture would suffer from the same disadvantages as the elastomeric-UHMWPE roll covers discussed above.

What is needed in the art is a paper machine roll cover that is economical to fabricate, is reliable when operated under adverse conditions, resists marking and damage, and can be ground to a high degree of smoothness.

SUMMARY OF THE INVENTION

The present invention provides an improved polyethylene particle filler for an elastomeric layer of a paper machine roll by modifying the surfaces of the polyethylene particles and by using particles of smaller particle size.

The invention comprises, in one form thereof, a surface layer for a paper machine roll cover, having a mixture of an elastomeric material and surface modified polyethylene particles.

In another form thereof, the invention provides a paper machine roll with a roll shell; an adhesive layer on the roll shell; and an outer layer of a mixture of an elastomeric material and surface modified polyethylene particles.

In a further form thereof, the invention provides a method of covering a paper machine roll having steps of providing a roll shell; applying an adhesive layer to the roll shell; providing polyethylene particles; modifying the surfaces of the polyethylene particles; mixing the surface modified polyethylene particles with an elastomeric material; and applying the mixture of surface modified polyethylene particles and elastomeric material to the roll shell.

An advantage of the present invention is providing a paper machine roll cover that is resistant to harsh operating conditions of temperature, pressure and chemicals.

Another advantage of the present invention is providing a paper machine roll cover that can be ground to a high degree of smoothness, exhibits good sheet release properties and is resistant to marking.

A further advantage of the present invention is providing a paper machine roll cover that is less expensive to manufacture than comparable paper machine roll covers of other compositions.

BRIEF DESCRIPTION OF THE DRAWINGS

The above-mentioned and other features and advantages of this invention, and the manner of attaining them, will become more apparent and the invention will be better understood by reference to the following description of an embodiment of the invention, taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
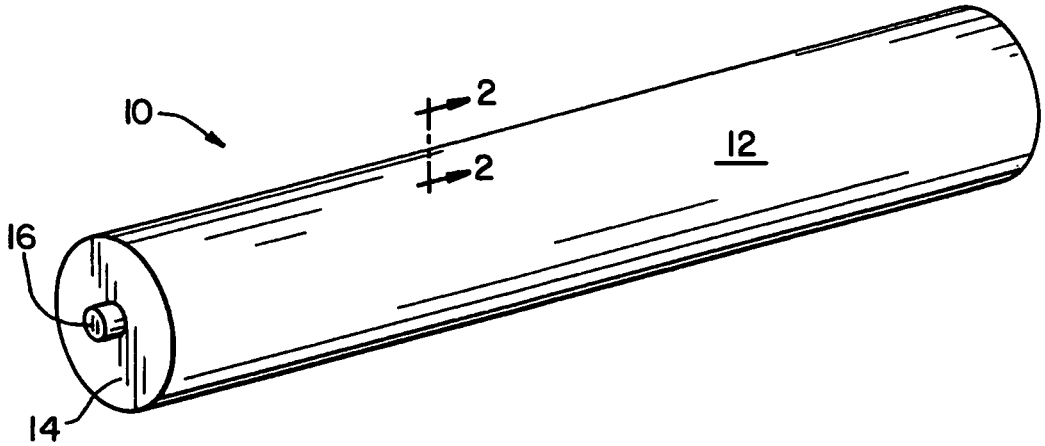
FIG. 1 is a perspective view of a paper machine roll having a cover according to the present invention.
Figure 2:
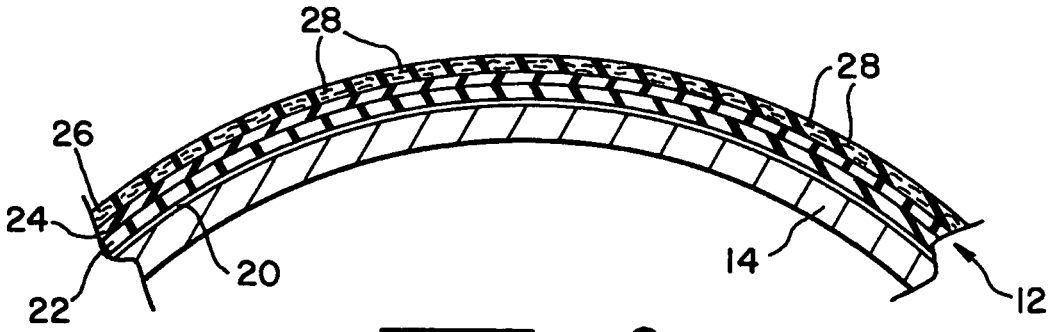
FIG. 2 is an enlarged, fragmentary cross-sectional view of the roll shown in FIG. 1, taken on line 2—2 of FIG. 1.

Referring now to the drawings, and more particularly to FIG. 1, there is shown a paper machine roll 10 that includes a roll cover 12 in accordance with the present invention. Cover 12 is provided on a roll shell or core 14.

In normal paper machine roll construction, core 14 is formed of steel or other metals and is substantially cylindrical and hollow. The length and width of core 12 will vary depending upon the paper machine in which the roll is to be installed, and the position in the paper machine in which the roll is to be used. Generally, core 14 extends the width of the paper machine, and may vary in diameter from less than a foot to six feet or more in diameter. Those skilled in the art will understand that core 14 will be provided with suitable stub shafts 16, through shafts, journals, bearings (not shown) and the like for mounting roll 10 in a paper machine. In that regard, roll 10 may be a controlled deflection roll including internal structures (not shown) for maintaining the desired straightness across the face of the roll. Frequently, roll 10 will be provided in a paper machine in nipped relationship to another roll or rolls. It also should be understood that the present invention is described for use in a paper machine, but also may have application and use in other industrial rolls. Paper machine rolls are a particularly advantageous use of the invention.

Cover 12 is a continuous rubber coating provided around the surface of core 14, and extends throughout the effective working face-length of roll 10. Hydrophobic and hydrophilic properties of rubber affect the performance of roll covers used in the manufacture of paper. The hydrophobic and hydrophilic properties affect the wet paper web attraction or release tendency from the roll cover surface, and consequently influence which cover of two adjacent covered rolls the paper web will follow. The tendency of the wet web to follow one roll or another can be used to guide the wet web through the paper machine. If the sheet has a tendency to follow a roll surface which it is not intended to follow, problems such as flutter, vibrations and sheet breaks can occur. In sizing and coating operations, the hydrophobic and hydrophilic properties of the cover affect the attraction of the size or coating solution to the surface of the cover, thereby influencing the thickness and the evenness of the size or coating distribution on the surface of the cover, and hence the quality of the size or coating operation.

It has been observed that the addition of High Density Polyethylene (HDPE) into rubber compounds varies the hydrophobic and hydrophilic properties of a surface coated with the rubber compound. As used herein in describing the present invention, and in the claims, references to HDPE or high density polyethylene particles shall be understood to mean polyethylene having an average molecular weight of less than about nine-hundred thousand (900,000), and preferably an average molecular weight of about one-hundred thousand (100,000). HDPE particles having a specific gravity of about 0.935 and higher have been found to be suitable, although particles having specific gravity greater than or less than this range also can be used. Preferred HDPE particles have had a specific gravity range from about 0.94 to about 0.96.

A hydrophilic rubber compound surface can be made gradually more hydrophobic by the addition of HDPE particles into the rubber compound formulation. A hydrophilic rubber compound having no HDPE can be made semi-hydrophobic by addition of as little as 12 phr (parts per hundred of rubber) of HDPE, and can be made mostly hydrophobic by the addition of even more HDPE.

The addition of HDPE into rubber compounds also affects the physical properties of the rubber compounds, resulting in improved resistance to abrasion and fracture. However, the amount of HDPE should be controlled, because the tendency of the compound to recover from indentation or marking suffers with an increased concentration of HDPE in the cover. Controlling the amount of HDPE from about 10 phr to about 50 phr results in rubber compound properties with improved abrasion and fracture resistance, with acceptable indentation and marking resistance properties for typical paper machine applications.

It has been found that modification of the surface of HDPE particles prior to the mixture thereof with the rubber compound improves physical properties of the resultant roll cover.

Surface modified polyethylene is polyethylene processed so as to modify its surface to facilitate the incorporation of polymer particles by formation of polar functional groups such as hydroxil and carboxylate. These surface functionalities facilitate strong adhesion of the particles to the elastomeric matrix.

The incorporation into elastomers of surface modified HDPE particles of size 35 microns or smaller results in roll covers with the required surface smoothness for critical paper machine operations and sliding abrasion resistance. Benefits in roll cover performance in other paper machine locations can be realized by using HDPE particles of about 100 microns average size, or smaller.

Furthermore, surface-treatment of HDPE particles results in improved resistance to permanent or transient marking, which is a critical property for the operation of paper machine roll covers (because any such marks translate into defects to the paper being processed). The non-surface treated particles result in poorer marking resistance because of the poorer adhesion between particle and matrix.

Surface modified HDPE particles are commercially available. The desired surface modification of the HDPE particles can be achieved by at least two methods. In a reactive gas process controlled oxidation occurs. The reactive gas process is believed to modify the HDPE particle surfaces to a significant penetration depth. As a result of the free radical mechanism, cross-linking of the surface molecules on the particles occurs in concert with the treatment. The cross-linking locks the modified areas in place, making the treatment a permanent treatment to the HDPE particle surface.

In a second process, known as the plasma treatment process, plasma is used to ablate the surface of the molecules as modification occurs. The result is a shallower treated layer, and the treatment is sometimes seen as less permanent. For these reasons, the reactive gas process is preferred for treating HDPE particles in accordance with the present invention. Preferred HDPE particles for the present invention have a surface energy of about 55+ dynes/cm.

Depending on the function of the roll surface and the conditions under which the roll will operate, the composition of the matrix component of cover 12 can be varied. Load, speed, roll cover position and chemical environment can affect the bonding of cover 12 to metal core 14. Three basic methods have been used. In a first method, an adhesive layer 20 is applied to core 14, followed by a hard base layer 22, usually 80 Shore D or greater in hardness. An intermediate layer 24, which is softer than base layer 22 is applied thereover, followed by a top stock layer or surface layer 26. Modified HDPE particles 28 are added to top stock layer 26.

In a second method, a hard or semi-hard material, which may be the base layer 22 or intermediate layer 24 from the first mentioned method, is bonded directly on top of adhesive layer 20 or on core 14, followed by the top stock layer 26 having modified HDPE particles 28 therein.

In a third method, the top stock layer 26 having modified HDPE particles 28 therein is applied directly on top of core 14, perhaps with the use of adhesive layer 20 between the surface of core 14 and the top stock layer 26.

In the first, or three-layer method described above, where the base is harder than the intermediate layer, which is harder than the top stock layer, a gradual transition of stresses from the top stock layer to the metal through the two intermediate layers is provided. This type of construction is well known to those skilled in the art for high load and high-speed positions in the paper machine, as well as positions where there are concerns of chemicals affecting the bonding of the cover to the metal core. Hard rubber generally resists chemicals to a greater degree than soft rubber compounds. Therefore, providing one or more intermediate layers of harder rubber between the softer top stock layer 26 and roll core 14 provides greater cover life by reducing bond failure between cover 12 and the surface of core 14.

Those skilled in the art will understand readily what materials are suitable to be used in base layer 22 and intermediate layer 24 for the three-layer construction. Roll cover manufacturers have preferred formulations for base layer 22 and intermediate layer 24, which may vary from one manufacturer to another. Core 14 is prepared by cleaning and blasting with an abrasive grit, and may be primed with a suitable adhesive 20. A base layer 22 thickness of about 2 mm or more is applied by extrusion onto core 14 surface. Commonly, base layer 22 is between about 2 mm and about 6 mm thick, most commonly about 4 mm thick, although thinner or thicker layers can be used. An intermediate layer 24 of 2 mm or more is applied directly on top of base layer 22 by extrusion. Commonly, intermediate layer 24 is between about 2 mm and 4 mm thick, but can be thicker. The top stock layer 26 can be any of several compounds applied directly on top of intermediate layer 24, again by extrusion. The selection of elastomeric materials used in top stock layer 26 depends on the paper machine position and the operating conditions in which the roll is to be installed. Hardness and other physical properties can be varied. It should be noted that roll cover manufacturers each have their own preferred formulations for each of the layers 22, 24 and the matrix component of layer 26.

In the second method, wherein two layers are provided, a first (or bottom) layer at least about 2 mm thick is applied by extrusion directly on top of the previously cleaned and abrasive blasted, adhesive primed metal core 14. Commonly, the bottom layer in the two-layer method is between about 2 mm and about 6 mm thick, but can be thicker. Top stock layers 26 as those described above for the first method can be applied directly to the first applied layer in this method.

In the single-layer method, any of the top stocks described above are applied by extrusion directly on top of the previously cleaned, abrasive blasted, adhesive primed metal core surface.

Application of layers 22, 24 and 26 has been described thus far herein as by extrusion; however, those skilled in the art will understand that extrusion is merely one of the acceptable application techniques, and other application techniques also can be used. For example, it is known to prepare pre-calendered sheets of elastomer or elastomer and filler mixtures, and hand lay the sheets on the roll. Techniques such as this can be used also in practicing the present invention.

Mixtures including elastomeric material of about 100 parts by weight mixed with surface modified HDPE particles of between about 10 parts by weight and about 80 parts by weight are preferred, although mixtures having the higher concentrations of particles may exhibit poorer denting resistance. Surface modified HDPE particles commonly are available in average sizes of between 18 microns and 500 microns. Smaller average particle sizes, of from about 14 microns to about 22 microns, are preferred in the present invention.

Preferred HDPE particles of the present invention have molecular weights of less than about 600,00, and preferably only about 100,000, as compared with UHWMPE particles which have a molecular weight many times greater. HDPE particles are commonly available in significantly smaller average particle sizes than are UHWMPE particles, such as, for example, 18 microns. The incorporation of surface modified HDPE particles of 18 microns average size in the covers mentioned above results in a cover with the required surface smoothness for critical paper machine operations and sliding abrasion resistance virtually as good as that of other filled elastomers. Additionally, HDPE particles of the preferred size are considerably less expensive than the even more course UHMWPE particles.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A surface layer for a roll cover in a paper machine manufacturing a paper web, said surface layer comprising:

an elastomeric material providing a continuous coating on the surface of the roll, said material selected for suitable performance under load, speed, temperature and chemical environment conditions of the paper machine roll position in which it is used for manufacturing a paper web; and surface modified HDPE particles mixed with said elastomeric material, said HDPE particles having an average molecular weight of less than about nine-hundred thousand (900,000).

2. The surface layer of claim 1, said elastomeric material comprising about 100 parts by weight and said HDPE particles comprising between about 10 parts by weight and about 80 parts by weight.

3. The surface layer of claim 1, said surface modified HDPE particles being modified with the formation of polar functional groups.

4. The surface layer of claim 3, said surface modified HDPE particles being modified by a reactive gas treatment.

5. The surface layer of claim 3, said elastomeric material comprising about 100 parts by weight and said HDPE particles comprising between about 10 parts by weight and about 80 parts by weight.

6. The surface layer of claim 3, said surface modified HDPE particles being modified by plasma ablation.

7. The surface layer of claim 1, said HDPE particles having a particle size of from about 14 microns to about 100 microns.

8. The surface layer of claim 1, said HDPE particles having a specific gravity of from about 0.94 to about 0.96.

9. The surface layer of claim 1, said HDPE particles having an average molecular weight of about one-hundred thousand.

10. The surface layer of claim 1, said surface modified HDPE particles having an average molecular weight of less than about six-hundred thousand.

11. The surface layer of claim 10, said HDPE particles having a specific gravity of from about 0.94 to about 0.96.

12. The surface layer of claim 11, said surface modified HDPE particles being modified by plasma ablation.

13. The surface layer of claim 12, said surface modified HDPE particles having an average particle size of about 18 microns.

14. A paper machine roll for use in manufacturing a continuous web of paper having a width, said roll comprising:

a roll shell having a length at least equal to the web width;

an adhesive layer on said roll shell; and an outer layer for said roll, said outer layer comprising a mixture of an elastomeric material and surface modified HDPE particles, said HDPE particles having an average molecular weight of less than about nine-hundred thousand (900,000), and said elastomeric material being a continuous coating around said shell and providing a face width on said roll at least equal to the web width, said elastomeric material selected for suitable performance under pressure, temperature and chemical conditions in a process to manufacture paper.

15. The paper machine roll of claim 14, said surface modified HDPE particles having an average molecular weight of about one-hundred thousand.

16. The paper machine roll of claim 15, said mixture including about 100 parts elastomeric material by weight and between about 10 parts and about 80 parts HDPE particles by weight.

17. The paper machine roll of claim 16, said HDPE particles having an average particle size of about 18 microns.

18. The paper machine roll of claim 16, said HDPE particles being surface modified by a reactive gas treatment.

19. The paper machine roll of claim 16, said surface modified HDPE particles being modified by plasma ablation.

20. A method of covering a paper machine roll for manufacturing a continuous web of paper having a width, said method comprising steps of:

providing a roll shell having a length at least equal to the web width;

applying an adhesive layer to the roll shell;

providing HDPE particles having an average molecular weight of less than about nine-hundred thousand (900,000);

providing an elastomeric material suitable for use under load, temperature and chemical conditions in a paper making process;

modifying the surfaces of the HDPE particles;

mixing the surface modified HDPE particles with the elastomeric material; and applying the mixture of surface modified HDPE particles and elastomeric material to the roll shell in a continuous layer around the shell and in a length on the shell at least equal to the web width.

21. The method of claim 20, said step of modifying the surfaces of the HDPE particles performed by a reactive gas treatment.

22. The method of claim 20, said step of modifying the surfaces of the HDPE particles performed by plasma ablation.

23. The method of claim 20, said step of providing HDPE particles including providing HDPE particles having an average molecular weight less than about one-hundred thousand.

24. The method of claim 23, including modifying the surface of the high density HDPE particles by a reactive gas treatment.

25. The method of claim 24, said high density HDPE particles having an average particle size of about 18 microns.

26. The method of claim 25, including mixing the HDPE particles and elastomeric material in a proportion comprising about 100 parts by weight of elastomeric material and between about 10 parts by weight and about 80 parts by weight HDPE particles.

27. The method of claim 20, including applying a base layer on the adhesive layer, and applying the mixture of surface modified HDPE particles and elastomeric material on the base layer.

28. The method of claim 20, including applying a base layer on the adhesive layer, applying an intermediate layer on the base layer, and applying the mixture of surface modified HDPE particles and elastomeric material on the base layer.

29. The method of claim 20, said HDPE particles having an average particle size less than about 100 microns.

30. The method of claim 20, including determining a desired level of hydrophobicity in the completed roll cover, and controlling the amount of surface modified HDPE particles in the cover to achieve the desired hydrophobicity.

* * * * *

UNITED STATES PATENT AND TRADEMARK OFFICE

CERTIFICATE OF CORRECTION

PATENT NO. : 7,014,604 B2
APPLICATION NO. : 10/198855
DATED : March 21, 2006
INVENTOR(S) : Vergara It is certified that error appears in the above-identified patent and that said Letters Patent is hereby corrected as shown below:

On the title page item (56), In column 1, under References Cited in U.S. Patent No. 3,920,325, delete "Switt", and substitute therefore --Swift--; and On the title page item (56), In Column 2, under Foreign Patent Documents, after "CA", delete "11147133", and substitute therefore --1,147,133--.

Signed and Sealed this

Second Day of January, 2007

JON W. DUDAS
*Director of the United States Patent and Trademark Office*